US008486202B2

(12) United States Patent
Haltmayer et al.

(10) Patent No.: US 8,486,202 B2
(45) Date of Patent: Jul. 16, 2013

(54) DISHWASHER

(75) Inventors: Werner Haltmayer, Dinkelsbühl (DE); Mathias Herrmann, Nattheim (DE); Stefan Kasbauer, Dillingen (DE); Claus Köther, Niederstotzingen (DE); Martin Weissenburger, Bissingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 962 days.

(21) Appl. No.: 12/381,884

(22) Filed: Mar. 17, 2009

(65) Prior Publication Data

US 2009/0267467 A1 Oct. 29, 2009

(30) Foreign Application Priority Data

Apr. 25, 2008 (DE) ..... 10 2008 020 888

(51) Int. Cl.
*B08B 3/00* (2006.01)

(52) U.S. Cl.
USPC ..... 134/56 D; 134/57 D; 134/200; 312/228

(58) Field of Classification Search
USPC ..... 134/56 D
See application file for complete search history.

(56) References Cited

U.S. PATENT DOCUMENTS

| | | | | |
|---|---|---|---|---|
| 6,200,155 | B1 * | 3/2001 | Chudkosky et al. | 439/371 |
| 6,737,622 | B1 * | 5/2004 | Jeong et al. | 219/756 |
| 2005/0183284 | A1 * | 8/2005 | Hwang et al. | 34/603 |

FOREIGN PATENT DOCUMENTS

| | | | |
|---|---|---|---|
| DE | 3614345 | C1 | 9/1987 |
| DE | 20303849 | U1 | 6/2003 |
| EP | 0382999 | A2 | 8/1990 |

* cited by examiner

*Primary Examiner* — Michael Kornakov
*Assistant Examiner* — Jason Ko
(74) *Attorney, Agent, or Firm* — James E. Howard; Andre Pallapies

(57) ABSTRACT

A dishwasher includes a washing compartment having a base wall with a retaining element, and a mains current connection element mounted on the retaining element with which a mains cable can be electrically contacted to the dishwasher.

18 Claims, 5 Drawing Sheets

Detail Z

DISHWASHER

BACKGROUND OF THE INVENTION

The invention relates to a dishwasher.

A plurality of device components which are connected in the hydraulic circuit, like for instance a sump, a washing liquor pump or a circulating pump, as well as control electronics components, which are energized by way of a mains current connection element arranged on the device side, are disposed below the washing compartment of a dishwasher.

A generic dishwasher has such a mains current connection element, with which a mains cable coming from the power supply network is electrically contacted with the electrical lines of the dishwasher on the device side.

When the dishwasher is assembled at the works, the mains current connection element can be pushed onto a receiving pocket present in the assembling base of the dishwasher. The washing compartment is then mounted on the assembling base.

In the case of a mounted dishwasher, the mains current connection element is thus only accessible from the outside with difficulty. This is particularly disadvantageous in the event of a subsequent disassembly of the mains current connection element. The handling of the dishwasher is also hampered in the case of a final examination occurring at the works after assembly. In the event of such a final examination, the dishwasher, which is almost completely assembled on the manufacturing line, undergoes a trial run. To this end, electrical contacts of a testing facility are contacted with the mains current connection element on the device side.

SUMMARY OF THE INVENTION

An object of the invention consists in providing a dishwasher, in which the mains current connection element is easily accessible from the outside and can be easily contacted in the case of a final inspection at the works.

The invention is based on a dishwasher, at least comprising a washing compartment and a mains current connection element, with which a mains cable can be electrically contacted with the dishwasher.

The washing compartment, in particular its base wall, has a retaining element, on which the mains current connection element is mounted. The mains current connection element is thus, contrary to the prior art, not provided on the assembling base of the dishwasher, but instead at a distance therefrom on a washing compartment wall, in particular on the washing compartment base wall.

It is simple in a manufacturing-relevant fashion for the retaining element to be integrated with the same material and/or in one piece on the washing compartment, in particular in the base wall thereof. The base wall with an integrated retaining element can be easily produced in the plastic injection-molding method in a manufacturing-relevant fashion. The base wall is thus a cost-effective plastic part upon which the remaining washing compartment walls made of special steel sheet are attached.

The electrical lines are guided from the mains current connection element to the electrically operated components and/or control electronics system, which are mostly arranged in the installation space below the washing compartment. To ensure a simple positioning of the electrical lines with a reduced line length on the device side, the retaining element can protrude downwards from the base wall of the washing compartment into the installation space existing therebelow, in which control electronics components as well as the device components connected in the liquid circuit are mounted.

The retaining element can preferably be spaced apart by a free height from the dishwasher base. The retaining element with the mains current connection element mounted thereupon is thus arranged in an easily accessible position above the assembling base and/or the dishwasher base optionally provided thereabove.

To facilitate accessibility, the retaining element can have a mounting wall, on which the mains current connection element can be mounted. The mounting wall can be molded on the front of the washing compartment base wall and protrude approximately vertically downwards in the region of the loading opening of the washing compartment. This mounting wall which protrudes downwards from the front of the washing compartment can delimit a correspondingly largely dimensioned tool access opening. In this way, in the case of a front panel which is distanced from the dishwasher, the installation space and/or the mains current connection element can be easily mounted and dismounted by means of tool access.

For easy assembly of the mains current connection element, the retaining element can have a mounting depression which is open particularly on the front of the device. The mounting depression according to a type of slot, which is preferably formed like a pocket, may help with a fixed positioning of the mains current connection element on the retaining element using its side walls.

In one embodiment, the mains current connection element may be a two part sheet metal casing for instance, which has two sheet metal shells which can be attached to one another for instance. The essentially closed housing can be provided with a contact block protruding through a housing wall. To contact the mains cable with the electrical lines on the device side, a mains cable end can be inserted into the housing and connected to the contact block. On the exterior of the housing, the electrical lines can be accordingly connected to the contact block.

In particular, in the case of mass production, the operability of each dishwasher is usually tested within the scope of a final examination. To this end, an automatically occurring contacting between a testing facility and the mains current connection element is advantageous in a process-relevant fashion. Such an examination takes place at the works at the end of a production line in the case of an almost mounted dishwasher.

A correct positioning of the mains current connection element is significant in respect of such an automatic contacting. To this end, the retaining element according to the invention can have a centering opening, in particular in the base of the afore-cited mounting depression, into which centering opening a centering section of the mains current connection element protrudes in the case of a correctly positioned arrangement.

For a simple centering of the mains current connection element, the centering opening can comprise a first opening section with a large opening cross-section and a second opening section with a smaller opening cross-section. The first opening section allows the centering section of the mains current connection element to be easily inserted into the centering opening. The actual centering is carried out by manually moving the mains current connection element into the second opening section.

After the centering process, the mains current connection element can be screwed to the retaining element in a correct positional arrangement. The centering opening thus configured can preferably feature an approximately T-shaped opening contour, with which the first opening section forms the cross beams of the T-shape and the second opening section protrudes centrally therefrom.

The afore-mentioned connection block may have a dual function, not only for electrical contacting purposes, but can at the same time also be used as a centering section in the centering opening of the retaining element. To position the mains current connection element in the centering opening in a stable fashion, the retaining element may also comprise a supporting flange, on which the mains current connection element and/or the centering section thereof is/are supported.

The supporting flange can extend directly along the opening edge of the centering opening in a contour-adapted fashion. The supporting flange is preferably arranged upstream of the centering opening in a mounting direction of the mains current connection element of the centering opening. The supporting wall is thus also used at the same time as a movement stop when inserting the mains current connection element into the mounting depression. In this case, the mains current connection element is connected to a front face of the supporting wall. To support the mains current connection element in a stable fashion, additional supporting ribs can be provided.

The retaining element may comprise a water drainage contour at least on its side facing toward the interior of the dishwasher, along which water drainage contour, draining drops of water are guided away from the mains current connection element. The water drainage contour can comprise at least one water drainage channel, which covers the mains current connection element in the direction of the vertical axis of the device. Liquid draining from above onto the mains current connection element is thus reliably guided away from the connecting element. For a simple design of the water drainage contour which is manufacturing-relevant, the base of the afore-mentioned mounting depression can be extended across its side walls and in this way form protruding ribs to allow water to drain off, which also at the same time delimit a water drainage channel.

BRIEF DESCRIPTION OF THE DRAWINGS

An exemplary embodiment of the invention is described below with reference to the appended figures, in which.

DETAILED DESCRIPTION OF THE PRESENT INVENTION

Figure 1:
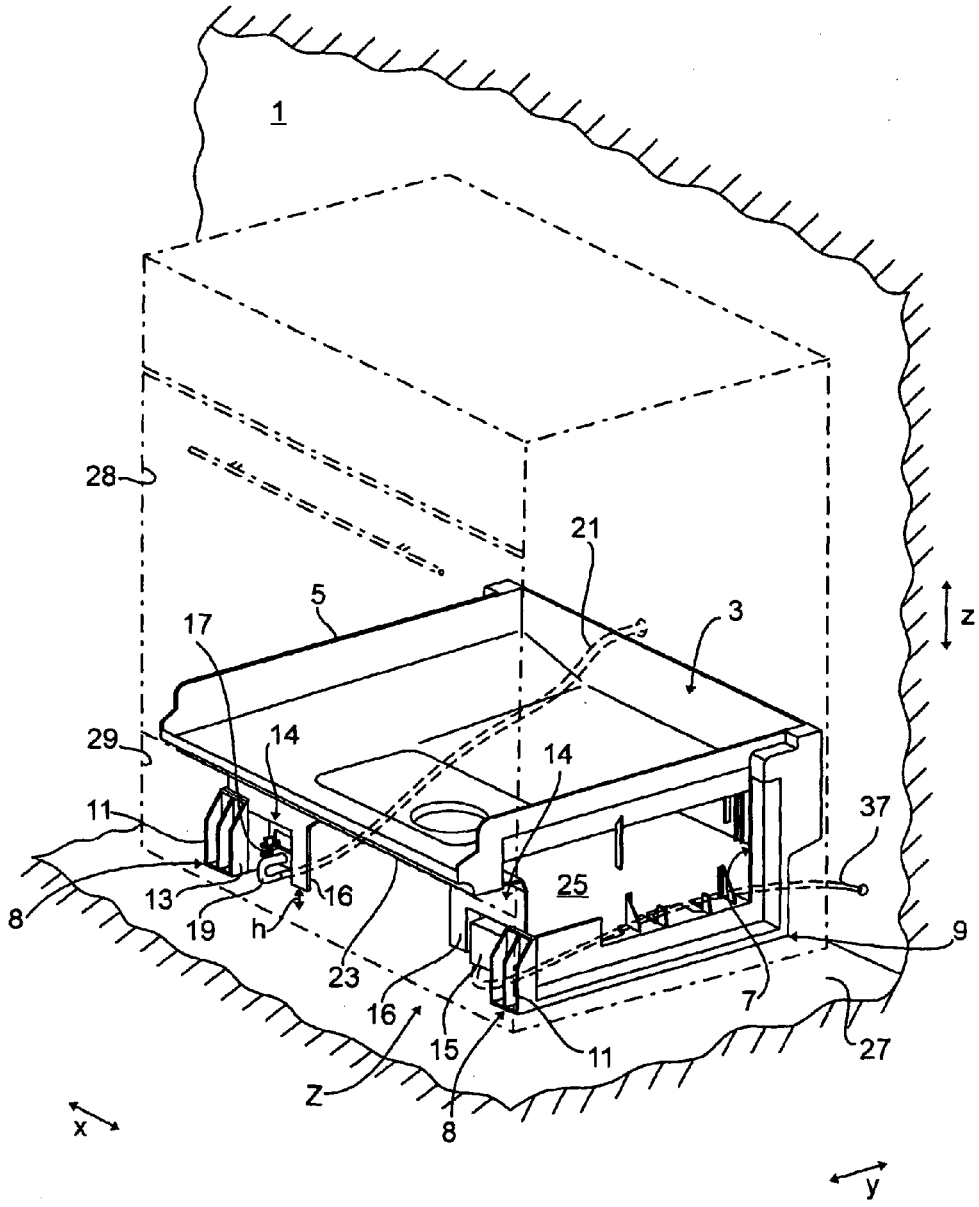
FIG. 1 shows a rough schematic representation of an installed dishwasher.

FIG. 1 shows a rough schematic perspective representation of a dishwasher mounted on a wall of a building 1. The housing side walls as well as the device door are only indicated with dashed lines for reasons of clarity. Only a base wall 3 of the washing compartment of the dishwasher is shown in order to understand the invention with more ease, while the sump, circulating pump, washing liquor pump or control electronics components are omitted in a representation of the overall washing compartment and/or the known device components.

The washing compartment base wall 3 shown in FIG. 1 is produced here by way of example as a plastic injection molded part. The base wall 3 is provided with laterally lifted edge sides 5, upon which the side walls (not shown) of the washing compartment, which are otherwise manufactured from high-grade steel, are placed. The base wall 3 delimits a dishwasher interior on the base side.

A supporting frame 7 is molded in each instance to the exteriors of the base wall 3 which lie opposite the lateral direction x of the device, said supporting frame bearing device feet (not shown) on its front and/or rear corner regions 8, 9 respectively. The two lateral supporting frames 7 each have guiding shafts 11 on their front corner regions 8, in which guiding shafts the device feet can be guided in a lifting manner. Retaining elements 14 for a mains current connection element 15 and for a water inlet valve (not shown), which belongs to a hydraulic circuit of the dishwasher, are provided in each instance on the side walls 13 of the guiding shafts 11 which face one another. To this end, each of the two retaining elements 14 has a mounting wall, which is molded on the assigned guiding shaft side wall 13 and on the lower side of the base wall 3. On the left mounting wall shown in FIG. 1 is mounted the water inlet valve by means of a connecting plate 17, to which an indicated bend 19 of a supply pipe 21 leading to the water supply network on the water inlet valve is connected.

The two front mounting walls 16 delimit a central tool access opening 23 to an installation space 25 below the washing compartment base wall 3. The installation space 25 is not delimited on the base side by an additional assembling base of the dishwasher, but is instead designed to be open.

As is further apparent from FIG. 1, the two front mounting walls 16 of the respective retaining elements 14 are spaced apart by a free height h from the dishwasher base 27, as a result of which an access possibility for the mounting and/or dismounting of the water inlet valve or of the mains current connection element 15 is simplified. To dismount these components, only a panel 29 provided on the front below the device door 28 is to be removed. As a result, the tool access opening 23 is exposed and easy access to the fastening elements of the water inlet valve and/or of the mains current connection element 15 can take place.

Figure 3:
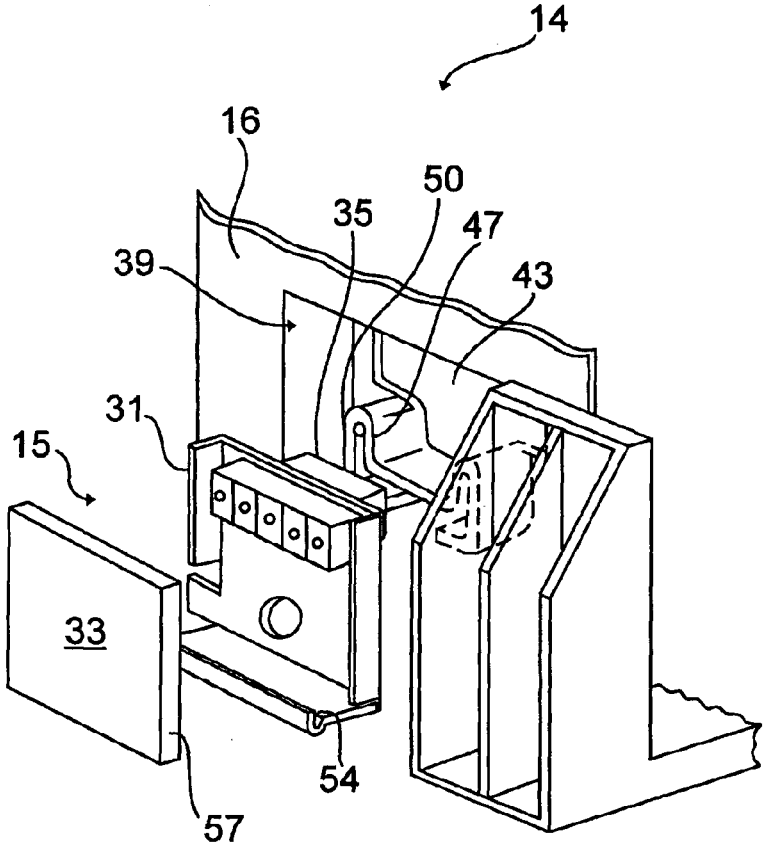
FIG. 3 shows a view according to FIG. 2 with a mains current connection element shown dismounted.

The mains current connection element 15 comprises sheet metal housing in accordance with FIG. 3, which is mounted on the retaining element 14 of the washing compartment base wall 3. According to FIG. 3, the housing is formed in two parts comprising a housing shell 31 and a housing cover 33. The housing shell 31 is penetrated by a connection block 35. The connection block 35 is contacted on the inside of the housing with a mains cable 37 coming from the power supply network. On the exterior of the housing the connection block 35 is connected to electrical lines 38, which are guided approximately to the control electronics components (not shown here).

Figure 2:
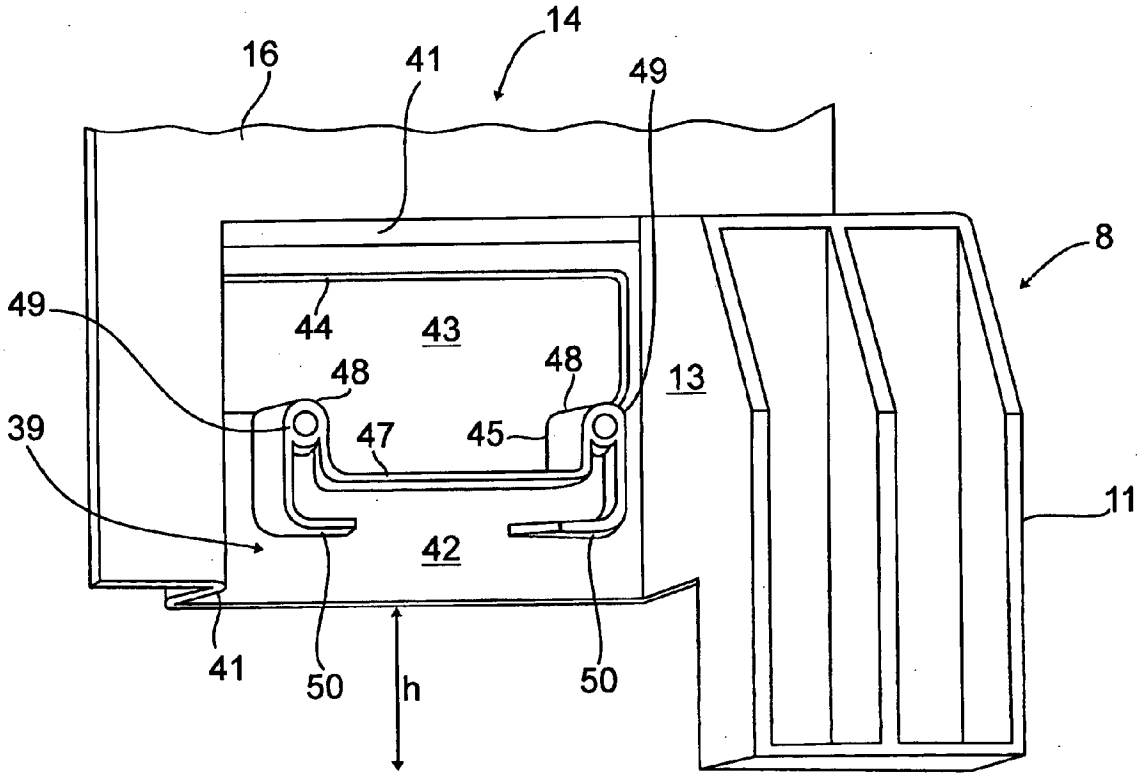
FIG. 2 shows an enlarged partial view of the detail Z from FIG. 1, in which the retaining element according to an exemplary embodiment of the invention is shown alone.

In accordance with FIG. 2, the mounting wall 16 has an open mounting depression 39 on the front of the device, into which the mains current connection element 15 is inserted. Only the retaining element 14 with the mounting depression 39 provided in its mounting wall 16 is shown in FIG. 2. Consequently, the mounting depression is embodied to be open and rectangular on its base and is delimited by the side walls 41 and/or the guiding shaft side wall 13. A T-shaped centering opening 43 with a first opening section 44 with a large opening cross-section and a second opening section 45 with a small opening cross-section are provided in the base of the mounting depression 39. The edge of the second opening section 45 is embodied with a supporting flange 47, which follows the edge of the small opening section 45 in a contour-adapted fashion and forms lateral centering shoulders 48. The connection block 35 is centered between the two centering shoulders 48 in accordance with FIG. 4.

In the region of the two centering shoulders 48, the supporting flange 47 in accordance with FIG. 2 passes into lateral screw bosses 49 in each instance. In addition, the supporting flange 47 is partially moved by the bent supporting rib 50, which runs approximately in parallel to the supporting flange 47 and at a distance therefrom. The front faces of the supporting flange 47 as well as the supporting ribs 50 form a depth stop in the case of the assembly of the mains current connection element 15, which positions the mains current connection element 15 in the installation depth direction y.

Figure 5:
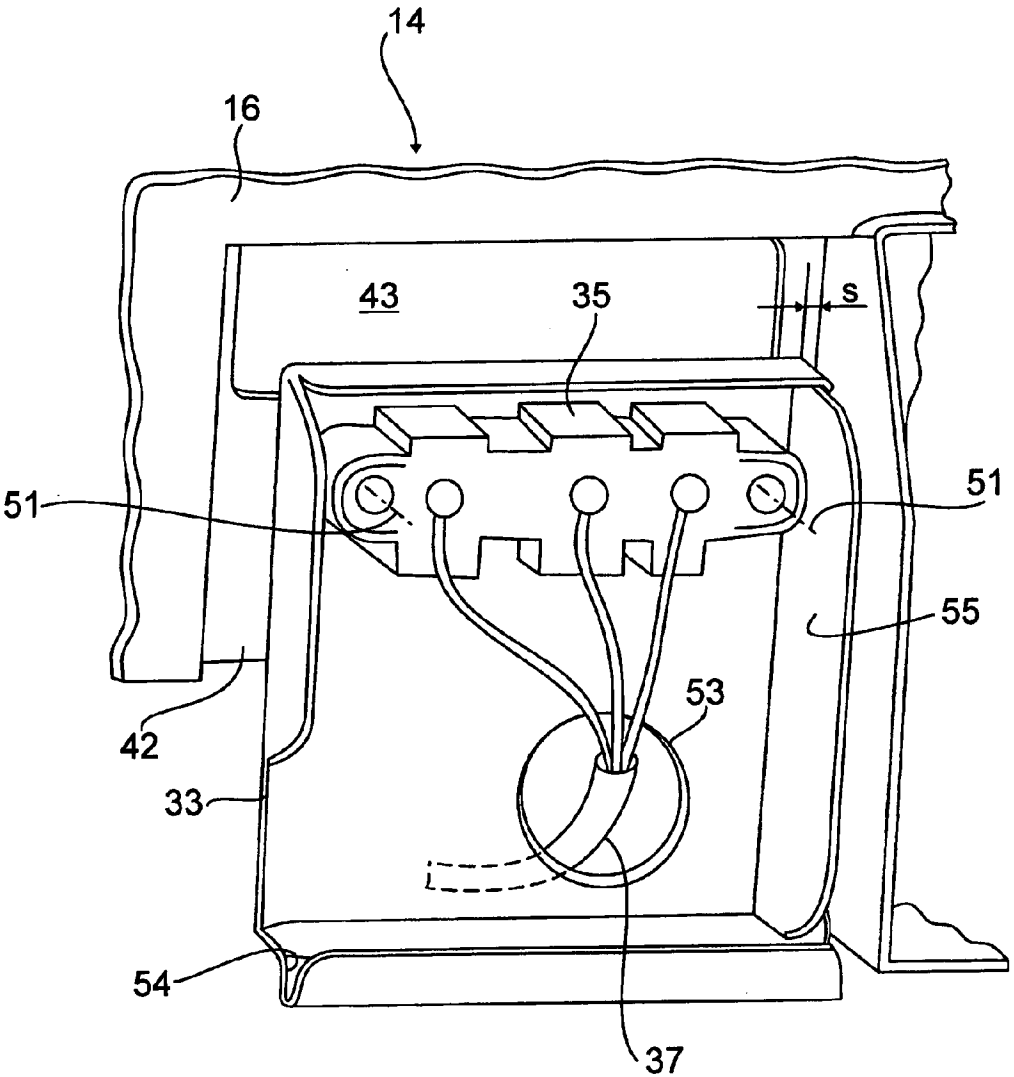
FIG. 5 shows a view from the front of the partially mounted mains current connection element.

The assembly of the mains current connection element is described with the aid of FIG. 3. Accordingly, the housing shell 31 with the connection block 35 functioning as a centering section is firstly inserted into the centering opening 43 so as to be in contact with the front faces of the supporting flange 47 and the supporting ribs 50. In the correct position, the connection block 35 of the housing shell 31 is then screwed 51 to the two screw bosses 49, as is shown in FIG. 5. In FIG. 5, the end of the mains cable 37 is guided through a passage opening 53 in the housing shell 31 in electrical contact with the connection block 35. The contacting of the mains cable 37 to the connection block can take place prior to or after fastening the housing shell 31 in the mounting depression 39.

In a following assembly step, the housing cover 33 is mounted on the housing shell 31. To this end, the cover 33 is inserted with its lower edge into a mounting groove 54 impressed into the lower edge flange of the housing shell 31 and is guided across the lifted side walls of the housing shell 31. To this end, in accordance with FIG. 5, a mounting slot s is provided between a side wall 55 of the housing shell 31 and the guiding shaft side wall 13, into which mounting slot s the corresponding side wall 57 of the housing cover 33 can be inserted.

Figure 4:
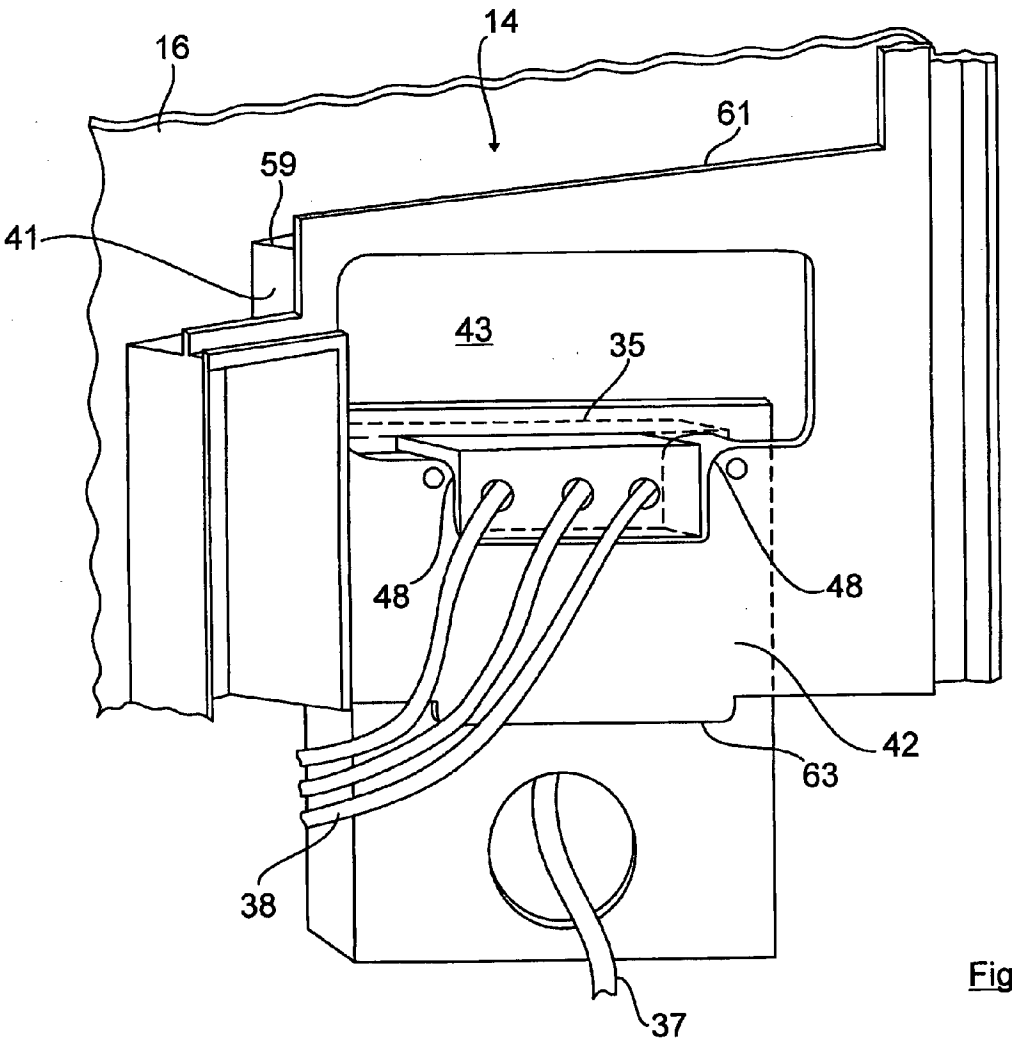
FIG. 4 shows a view of the retaining element from the rear with a mounted mains current connection element.

In FIG. 4, the retaining element 14 according to the invention is shown in a view from the rear as well as in the case of a mounted network current connection element 15. Accordingly, the connection block 35 sits in a form-fit manner between the two centering shoulders 48. The electrical lines 38, which lead to the electrical components on the device side, are already connected to the connection block 35.

In accordance with FIG. 4, a water drainage contour with water drainage channels 59 as well as water drainage ribs 61 are integrated in the rear of the mounting wall 16. The water drainage contour is configured without additional undercuts, which would render more difficult a deformation process using the injection molding method, with which the injection molding tools are moved apart in a deformation direction following deformation.

In FIG. 4, the base 42 of the mounting depression 39 is extended beyond the side walls 41 thereof and thus forms the water drainage rib 61. This covers the mains current connection element 15 in a vertical axis z of the device. Its top edge is inclined downwards in respect of the horizontal. The water drainage channel 59 is formed between the water drainage rib 61 and the mounting wall 16 running in parallel thereto, the channel base thereof being formed by the upper, horizontally running side wall 41 of the mounting depression 39.

As also apparent from FIG. 4, a reinforcing rib 63 is molded to the lower, open end of the base 42 of the mounting depression 39, said reinforcing rib on the whole configuring the retaining element 14 in a more warp-resistant and/or inherently stable fashion.

The invention claimed is:

1. A dishwasher comprising:

a front door;

an access panel;

a washing compartment having a base wall with a retaining element, the retaining element configured to accept a mains cable for electrical connection of the dishwasher; and a mains current connection element mounted directly on the retaining element for the electrical connection, wherein the access panel is mounted to the dishwasher at a position adjacent to and below the front door of the dishwasher, and wherein the retaining element for the electrical connection is disposed at a position adjacent to and behind the access panel.

2. The dishwasher of claim 1, wherein the retaining element forms a unitary structural element with the base wall as a single injection molded unit.

3. The dishwasher of claim 1, wherein the retaining element extends from the base wall into an installation space between the washing compartment and a dishwasher base.

4. The dishwasher of claim 3, wherein open space separates the retaining element from a floor surface that the dishwasher rests upon.

5. The dishwasher of claim 1, wherein the retaining element has a mounting wall on the front of the washing compartment base wall, upon which the mains current connection element is mounted.

6. The dishwasher as claimed in claim 5, wherein the mounting wall delimits the installation space below the washing compartment by forming a tool access opening.

7. The dishwasher of claim 1, wherein the retaining element defines a mounting depression which is open on a device side, into which the mains current connection element can be inserted.

8. The dishwasher of claim 7, further comprising at least one mounting depression side wall, wherein a base of the mounting depression extends beyond the at least one mounting depression sidewall in order to form a water drainage rib and/or a water drainage channel above the mains current connection element.

9. The dishwasher of claim 7, wherein the retaining element defines a centering opening in a base of the mounting depression, into which a centering section of the mains current connection element protrudes.

10. The dishwasher as claimed in claim 9, wherein the centering opening of the retaining element has a first opening section with a first opening cross section and a second opening section with a second opening cross section, in which the mains current connection element is centered, with the second opening cross-section being larger than the first opening cross-section.

11. The dishwasher of claim 9, wherein the retaining element has a supporting flange adjusted to a contour of the centering section of the mains current connection element on which the centering section is supported.

12. The dishwasher of claim 11, wherein the supporting flange is configured to accept a housing shell of the mains current connection.

13. The dishwasher of claim 11, wherein the mains current connection element is connected to a front face of the supporting flange and/or an additional supporting rib.

14. The dishwasher of claim 1, wherein the retaining element has bolts for a screw connection with the mains current connection element.

15. The dishwasher of claim 1, wherein the retaining element defines a water drainage contour on a side facing a dishwasher installation space which guides draining drops of water away from the mains connection element.

16. The dishwasher of claim 15, wherein the water drainage contour defines a water drainage channel which covers the mains current connection element in a vertical axis direction of the device.

17. The dishwasher of claim 1, wherein the retaining element is outside a dishwasher interior.

18. A dishwasher with a unitarily structured washing compartment base wall, the dishwasher including a front door and an access panel, comprising:

at least one retaining element configured to accept an electrical main current connection for making an electrical connection to the dishwasher from an electrical supply external to the dishwasher; and at least one lateral support frame, including a guiding shaft and configured to support a total weight of the dishwasher; wherein the at least one retaining element comprises a mounting wall molded on the guide shaft, the mounting wall being configured for direct mounting of a housing for the electrical main current connection; and wherein the access panel is located below the front door of the dishwasher, and the retaining element for the electrical main current connection is located behind the access panel.

* * * * *